United States Patent [19]

Pringle

[11] Patent Number: 4,760,879

[45] Date of Patent: Aug. 2, 1988

[54] CHOKE AND KILL CONTROL SYSTEM

[75] Inventor: Ronald E. Pringle, Houston, Tex.

[73] Assignee: Camco, Incorporated, Houston, Tex.

[21] Appl. No.: 126,137

[22] Filed: Nov. 27, 1987

[51] Int. Cl.[4] ..... E21B 23/03; E21B 34/10

[52] U.S. Cl. ..... 166/117.5; 166/323; 166/332

[58] Field of Search ..... 166/117.5, 117.6, 321, 166/323, 324, 325, 332

[56] References Cited

U.S. PATENT DOCUMENTS

| | | | |
|---|---|---|---|
| 4,161,960 | 7/1979 | Watkins | 137/461 |
| 4,325,431 | 4/1982 | Akkerman | 166/117.5 |
| 4,407,363 | 10/1983 | Akkerman | 166/117.5 |
| 4,434,847 | 3/1984 | Vazquez et al. | 166/117.5 |
| 4,527,631 | 7/1985 | Vazquez | 166/117.5 |
| 4,585,067 | 4/1986 | Blizzard et al. | 166/386 |
| 4,651,822 | 3/1987 | Johnston et al. | 166/323 |

*Primary Examiner*—Stephen J. Novosad
*Assistant Examiner*—Terry Lee Melius
*Attorney, Agent, or Firm*—Fulbright & Jaworski

[57] ABSTRACT

A choke and kill control system for stopping production of an oil and/or gas well by injecting a fluid from the outside of the well conduit into the well bore through a check safety valve. A biasing piston and cylinder assembly initially latches the valve in the open position and is actuated by a retrievable control positioned in a sidepocket mandrel. The control may be a bias valve, a rupture disc, or may be a blanking plug for maintaining the valve in the open position. The assembly may be flushed and cleaned when desired to overcome well contamination.

9 Claims, 13 Drawing Sheets

CHOKE AND KILL CONTROL SYSTEM

BACKGROUND OF THE INVENTION

U.S. Pat. No. 4,585,067 discloses a choke and kill valve which is initially latched in the open position by a piston and cylinder assembly. However, that assembly is actuated by the difference between the pressure of a control fluid and the pressure in the well tubing. Since the control fluid extending to the well surface includes hydrostatic pressure, the assembly is subject to inadvertently closing the choke and kill valve in the event that the tubing pressure decreases. Another disadvantage of the prior art system is that once it is set in place the closing force cannot be changed to meet changing well conditions without pulling the entire tubing string. In addition, such a valve does not have a positive lockout which is desirable when using workover tools in the well. Furthermore, the hydraulic piston and cylinder assembly is subject to well contamination which may interfere with its operation.

The present invention overcomes the disadvantages of the prior art by using a control system having a sidepocket mandrel having a flow control means which is insensitive to tubing pressure and can be retrieved and replaced for changing the actuating pressure and can be provided with a blanking plug for locking the kill valve in the open position. Additionally, the hydraulic piston and cylinder assembly can be flushed out and cleaned when desired.

SUMMARY

The present invention is directed to a control system for use in a well conduit in which the choke and kill valve includes a housing having a bore therethrough, a sleeve telescopically movable in the housing about the bore, a valve closure member positioned in the housing and connected to the sleeve and movable between open and closed positions in the bore. A flow tube is longitudinally movable in the housing for controlling movement of the valve closure member and biasing means act between the sleeve and the flow tube in a direction for causing the valve closure member to move to a closed position. Releasable latch means are provided between the sleeve and the flow tube initially holding the flow tube in position for holding the valve closure member in the open position. A biased piston and cylinder assembly initially engages the releasable latch and holds the latch engaged. The assembly is exposed on one side to pressure in the housing. The housing and the sleeve include coacting openings which when aligned by movement of the sleeve by well pressure allows fluid to be inserted into the bore from outside of the housing. A sidepocket mandrel is provided having a bore in communication with the bore of the housing and a sidepocket including an inlet port for receiving a control fluid from the well surface. The sidepocket includes an outlet port in communication with the second side of the piston and cylinder assembly. Flow control means are releasably positioned in the sidepocket for controlling the passage of control fluid between the inlet and the outlet port for controlling the piston and cylinder assembly.

Still a further object of the present invention is wherein the flow control means is a control valve having a valve seat and a valve element which is biased to the closed position and the control fluid at the inlet port acts on the control valve in a direction to open the control valve. Preferably, the control valve is biased to the closed position by a nitrogen charge and is insensitive to pressure of the well fluid in the bore. The flow control means may also include a rupture disc.

Still a further object of the present invention is wherein the flow control means includes a blocking valve shutting off flow between the inlet port and the outlet port for positively holding the choke and kill valve in the open position with a lockout positioned out of the path of movement of any well tools.

Still a further object of the present invention is the provision of a weep hole between the sidepocket and the mandrel bore downstream of the flow control means for preventing inadvertent actuation of the choke and kill valve when the flow control means is inserted in the sidepocket.

Yet a still further object of the present invention is wherein the piston and cylinder assembly includes non-positive seal means and includes a flush opening normally closed by the flow tube but opened by downward movement of the flow tube and exposed to the bore for allowing the assembly to be flushed and cleaned.

A blanking plug means is provided for insertion into and closing the bore of the housing and for engaging and moving the flow tube and piston downwardly for exposing the assembly for flushing the assembly.

Yet a still further object of the present invention is wherein the flow control means includes a flush control means having seal means for sealing on each side of the inlet port and a passageway therethrough for passing flushing fluid from and to the mandrel bore to the outlet port for cleaning the piston and cylinder assembly.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
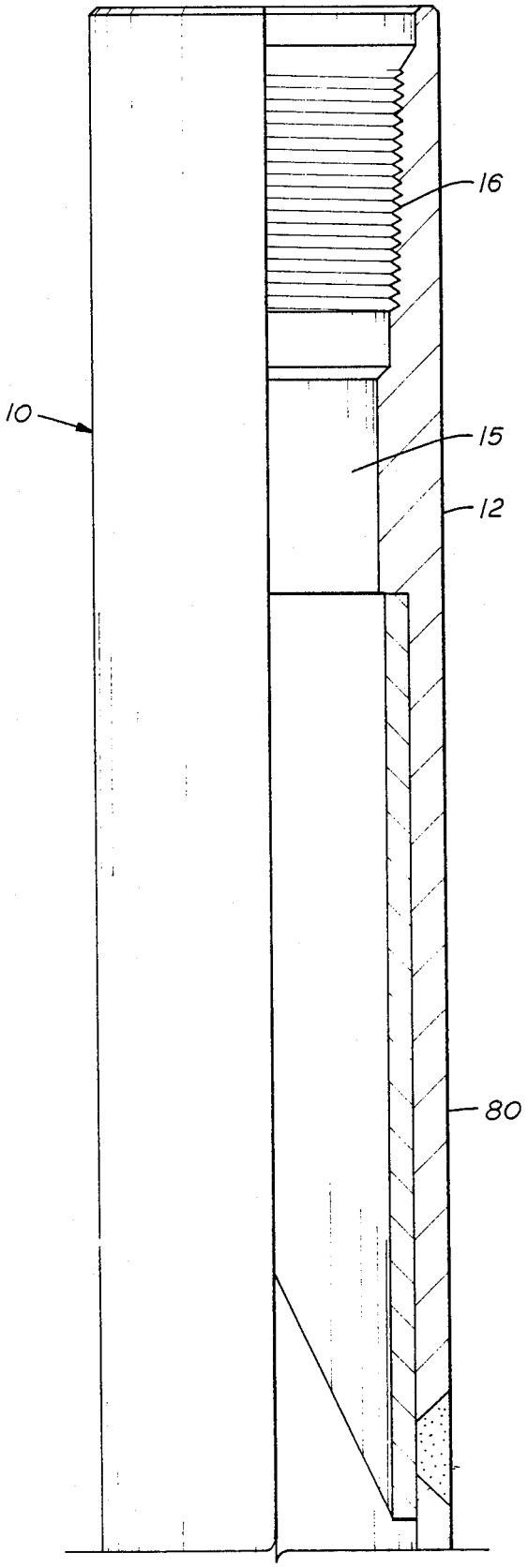
FIGS. 1A, 1B, 1C, 1D, 1E, 1F, 1G, and 1H are continuations of each other and form an elevational view, partly in cross section, of the apparatus of the present invention.
Figure 1B:
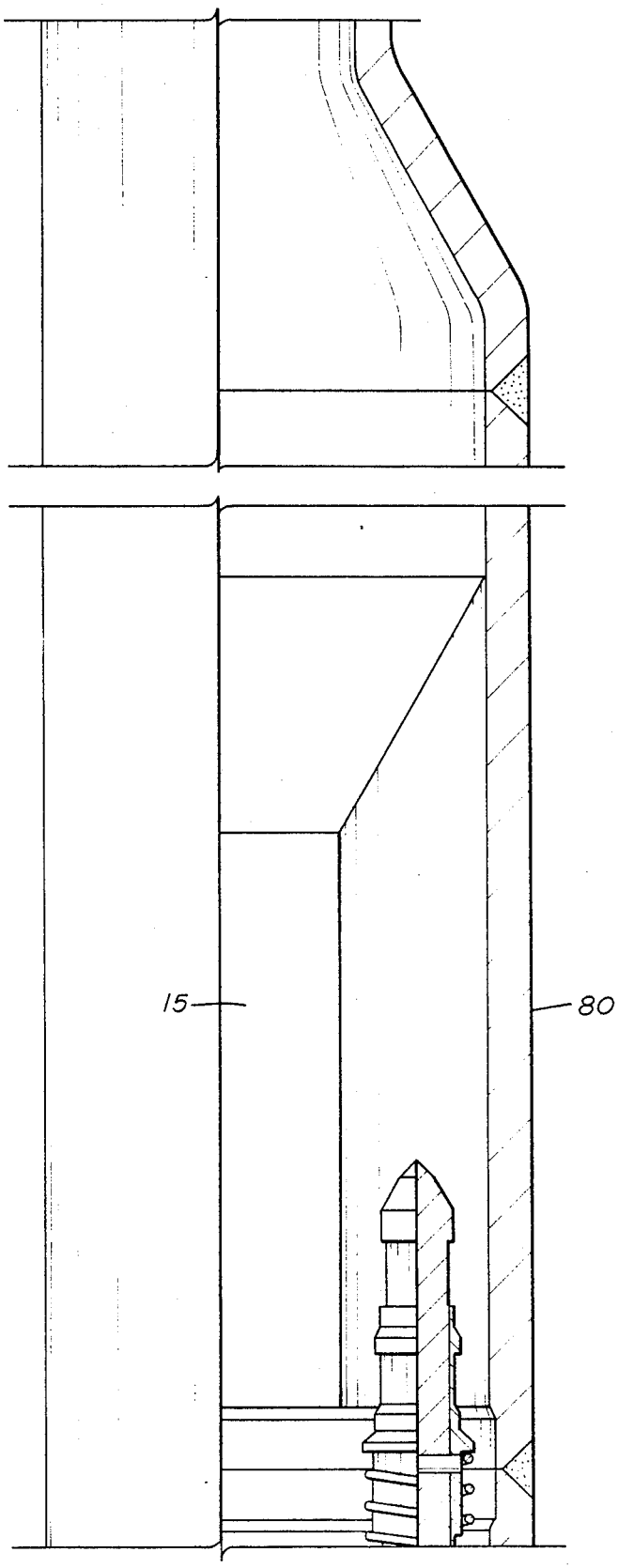

Referring now to the drawings, and particularly to FIGS. 1A, 1B, 1C, 1D, 1E, 1F, 1G and 1H, the circulating choke and kill valve of the present invention is generally indicated by the reference numeral 10 and generally includes a housing 12 having a bore 14 (FIGS. 1E–1H) therethrough and connecting means such as an upper thread 16 and a lower thread 18 for connection in an oil and/or gas well production tubing or conduit.

A tubular sleeve 22 (FIGS. 1G and 1H) is telescopically movable in the housing 12 but release means such as collet fingers 20 coact with a shoulder 24 on the sleeve 22 for initially positioning the sleeve 22 in the position shown.

Figure 1C:
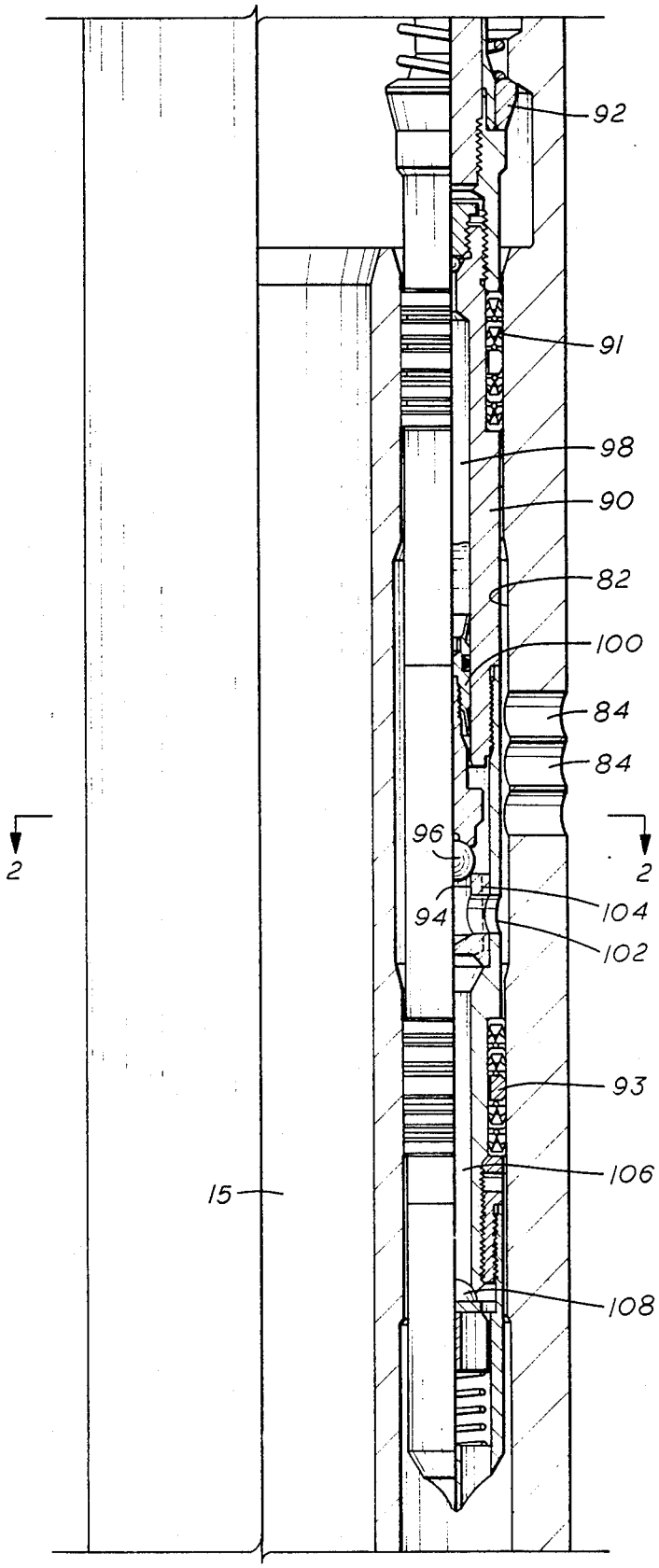
Figure 1D:
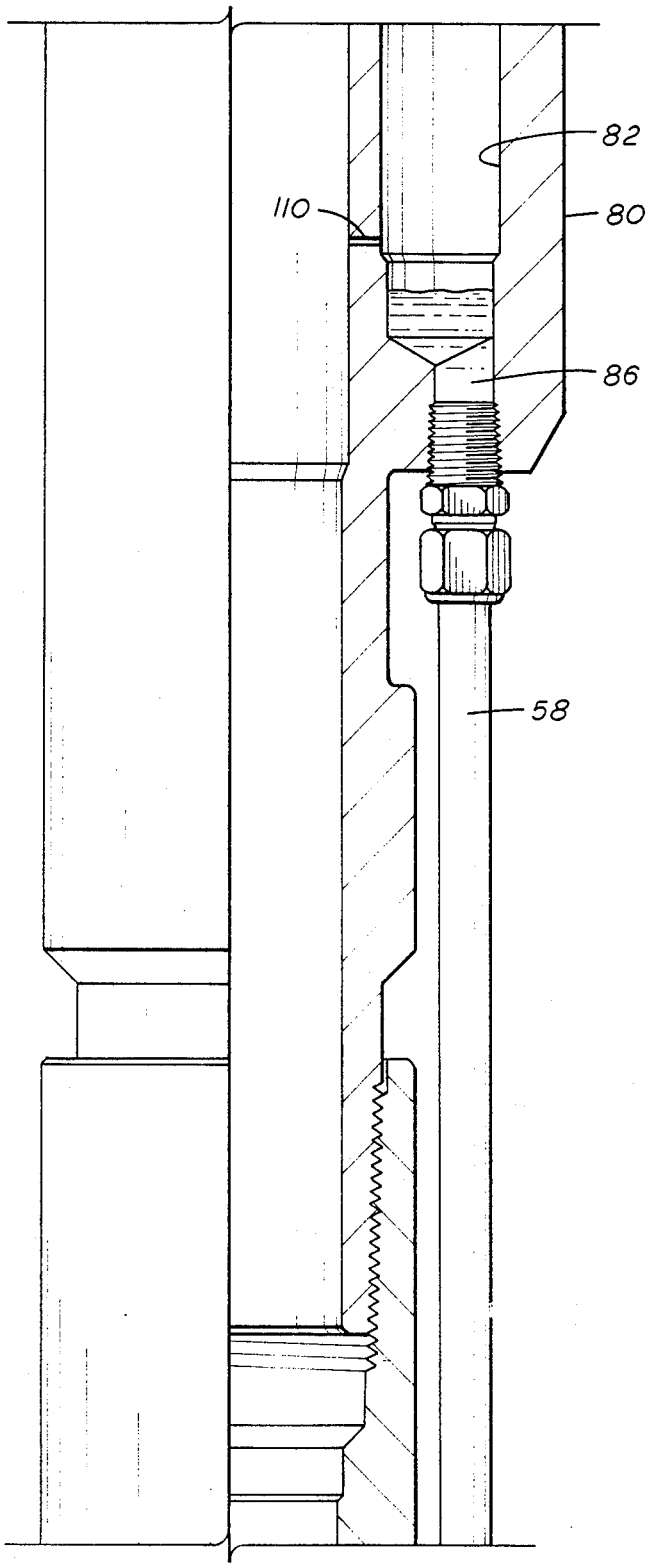
Figure 1E:
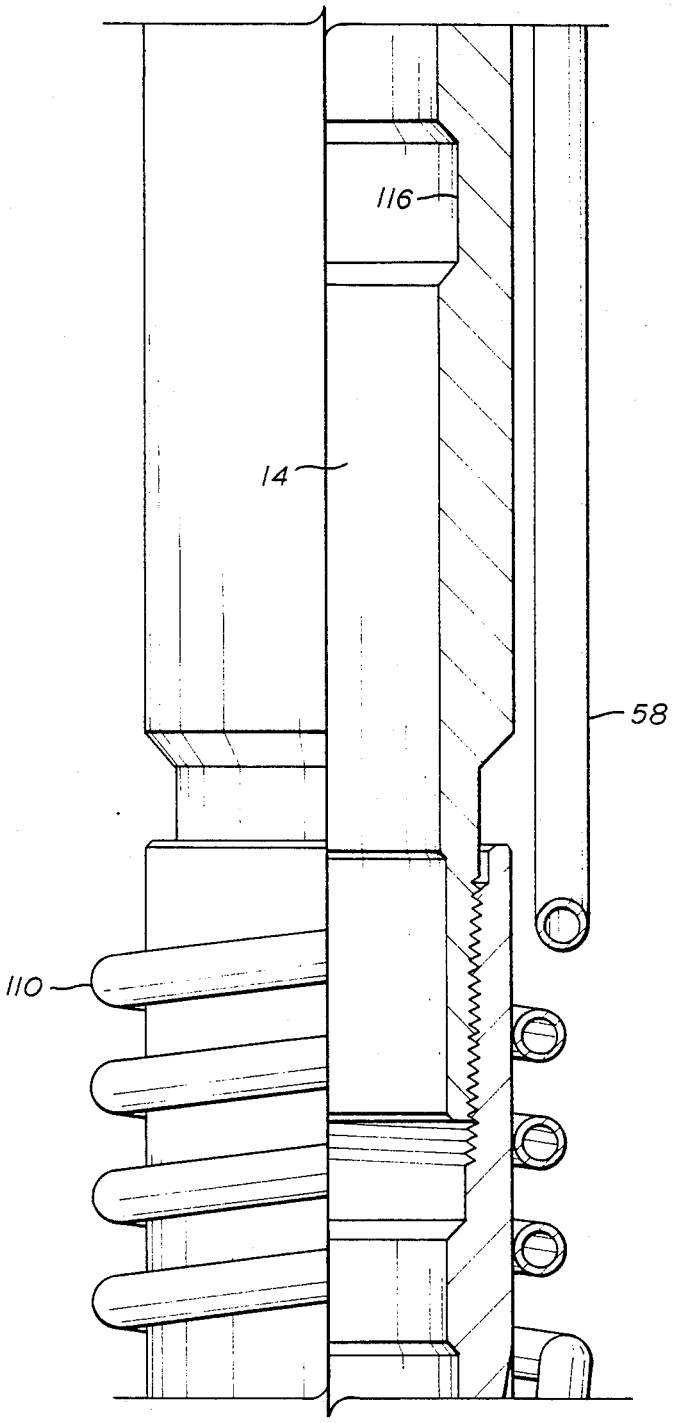
Figure 1F:
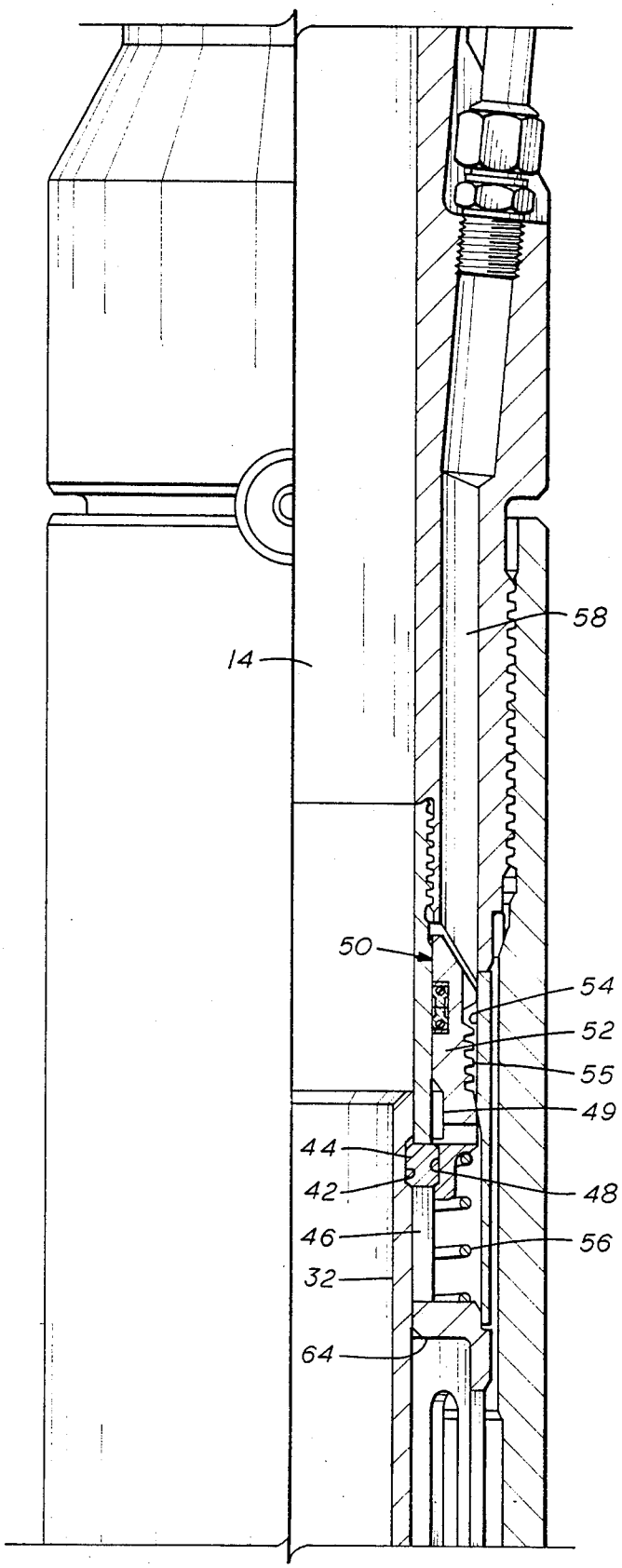
Figure 1G:
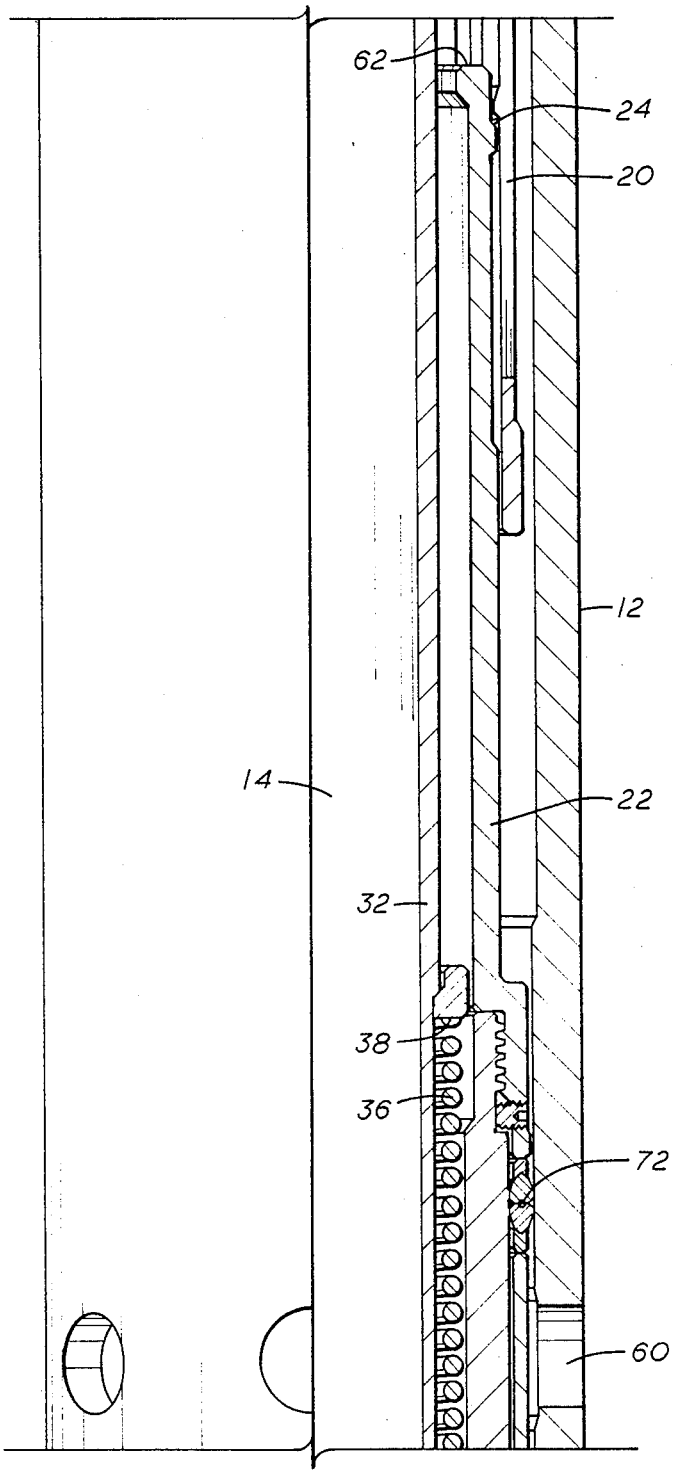
Figure 1H:
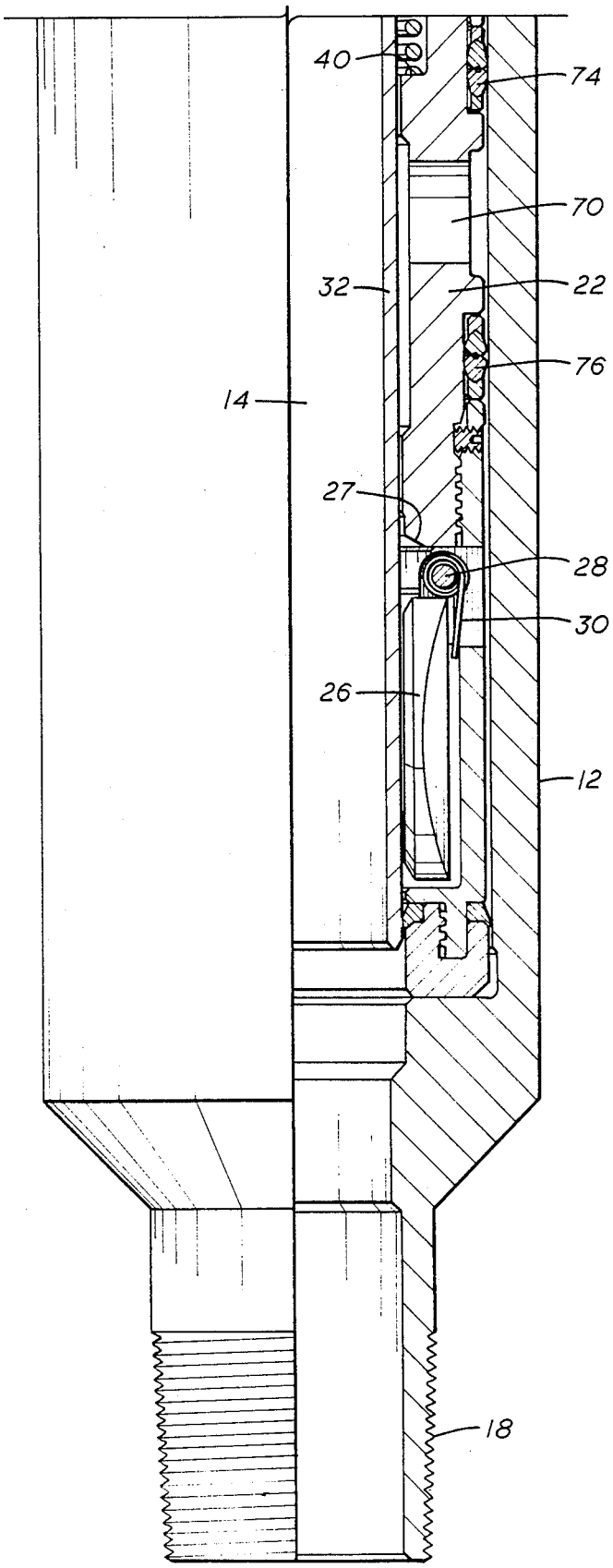

A check valve closure member such as flapper valve 26 (FIG. 1H) is positioned in the housing 12 and connected to the sleeve 22 by pivot connection 28 and is movable from an open position, as best seen in FIG. 1H, to a closed position on valve seat 27 to shut off upward flow through the bore 14, but to allow downward flow through the bore 14. The member 26 is urged to a closed position by a spring 30 and is moved to an open position by a flow tube 32. Flow tube 32 is longitudinally movable in the housing 12 for controlling the movement of the check valve member 26 and when moved relative to the sleeve 22 to a downward position moves the valve closure member 26 to the open position. When the flow tube 32 is moved upwardly out of the path of movement of the valve member 26, the valve member 26 is moved to the closed position. Biasing means such as a spring 36 is provided between a shoulder 38 on the flow tube 32 and a shoulder 40 on the sleeve 22 for biasing the flow tube 32 in a direction for allowing the valve member 26 to move to the closed position.

The valve 10 is normally installed and held in an open position. In order to hold the valve element 26 in the open position with the flow tube 32 in a downward position, a releasable and reengagable latch means is provided. As best seen in FIG. 1F, a groove 42 is provided in the outside of the flow tube 32 and a locking dog 44 is engaged in the groove 42 and in an opening 46 in the sleeve 22 thereby preventing longitudinal movement of the flow tube 32 relative to the sleeve 22. The dog 44 is initially prevented from being displaced from the groove 42 by a shoulder 48.

A spring biased piston and cylinder assembly generally indicated by the reference numeral 50 initially holds the releasable latch means in engagement with the flow tube 32. The assembly 50 includes a piston 52 movable in a cylinder 54. The piston 52 is biased upwardly in the cylinder 54 by a biasing spring 56. The piston 52 is connected to the shoulder 48 which includes a release groove 49. Initially, the spring 56 retains the shoulder 48 behind the locking dog 44. The assembly 50 is exposed on one side, such as the bottom side, by the pressure in the well bore 14. The pressure in the bore 14 flows around the flow tube 32 since there are no seals between the flow tube 32 and the sleeve 22 and acts on the underside of the piston 52 in a direction to maintain the releasable latch in the latched position. The assembly 50 is exposed on the second top side to a fluid control pressure in passageway 58 as will be described more fully hereinafter.

Upon the application of a predetermined pressure in the passageway 58, the piston 52 moves downwardly moving the release groove 49 into register with the dog 44 which therefore moves out of the groove 42 at which time the biasing spring 36 moves the flow tube 32 upwardly allowing the check valve member 26 to close the bore 14.

After the check valve 26 is closed, the formation pressure in the bore 14 below the valve closure member 26 moves the sleeve 22 upwardly to a position to receive injection fluid from the outside of the valve 10. The differential pressure across the check valve 26 overcomes the force of the collet fingers 20 acting against the shoulder 24 on the sleeve 22 causing the sleeve 22 to move upwardly until the sleeve shoulder 62 engages the housing shoulder 64.

A fluid path is then established between the outside of the housing 12 and the bore 14 which includes one or more fluid openings 60 (FIG. 1G) in the housing 12 and one or more fluid openings 70 (FIG. 1H) in the sleeve 22. The communication path is closed when the sleeve 22 is in its initial position by the metal seals 72, 74 and 76. However, when the sleeve 22 is moved upwardly with the shoulder 62 contacting the shoulder 64 on the body 12, the openings 60 and 70 are aligned. Injection fluid may now be pumped down the annulus between the outside of the body 12 and the inside of the casing (not shown), through the openings 60 and 70 and downardly through the check valve 26, which will open in response to fluid flow and the fluid is pumped into the production tubing to kill the production.

The above description of a choke and kill valve is generally disclosed in U.S. Pat. No. 4,585,067. However, in that valve the top of the piston 54 was exposed directly to annulus control fluid extending to the well surface and the piston and cylinder assembly 50 was actuated by the pressure differential of the control fluid and the pressure in the tubing bore 14. This was disadvantageous in that the piston and cylinder assembly 50 could be actuated without any increase in the pressure in the control fluid from the well surface. That is, a decrease in the pressure in the bore 14 would cause the kill valve to be inadvertently actuated because of the hydrostatic head in the control fluid in the annulus.

The present invention utilizes a sidepocket mandrel having a flow control means releasably positioned in the sidepocket for controlling the actuation of the piston and cylinder assembly 50 in which the flow control means may be insensitive to tubing pressure in the bore 14. Thus, as best seen in FIGS. 1A, 1B, 1C and 1D, a conventional sidepocket mandrel 80 is provided having a bore 15 which is in communication with the bore 14. The mandrel 80 includes a sidepocket 82 (FIG. 1C) having one or more inlet ports 84 for receiving control fluid from the well surface and the sidepocket 82 includes an outlet port 86 FIG. 1D) which is in communication with the control passageway 58 leading to the top of the piston and cylinder assembly 50.

Figure 2:
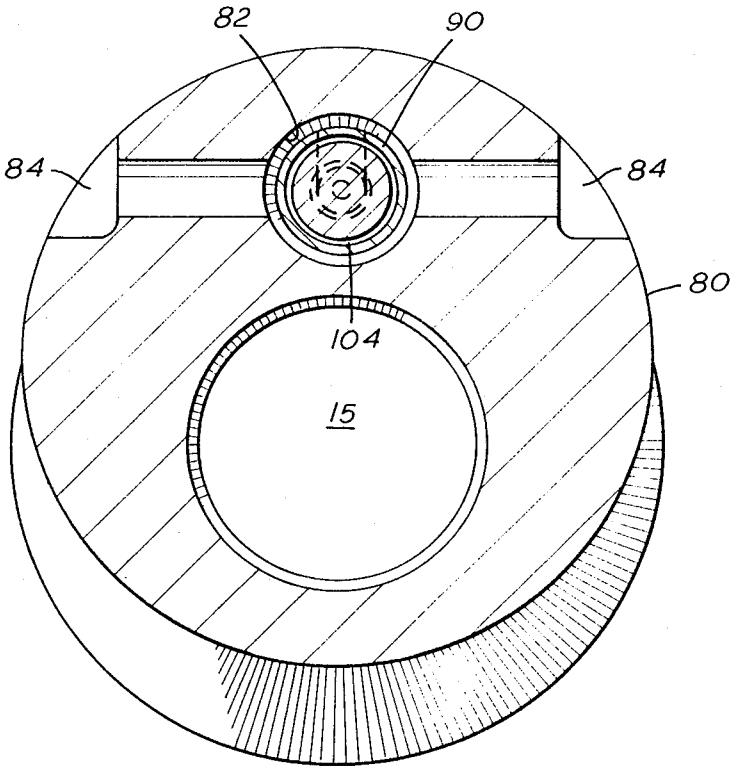
FIG. 2 is a cross-sectional view taken along the line 2—2 of FIG. 1C.

A flow control means such as valve 90 is releasably positioned in the sidepocket 82 for controlling the flow of fluid between the inlet port 84 and the outlet port 86. The valve 90 is conventionally releasably locked in the sidepocket 82 by conventional lock 92. Referring now to FIGS. 1C and 2, the valve 90 includes a valve seat 94 and a valve element 96 which is biased to a closed position, preferably by a nitrogen charge 98 acting on a piston 100 which is connected to the valve element 96. The valve 90 includes an inlet 102 which is in communication with the inlets 84 for supplying hydraulic control fluid against the bottom of the valve element 96 acting in a direction to open the control valve. Cross over passageways 104 extend from the backside of the valve element 94 to a passageway 106. The nitrogen charge 98 in the control valve 90 may be suitably set, such as to provide a force to counteract the hydrostatic head of the hydraulic control fluid acting to open the control valve 90 plus a predetermined amount, such as 500 pounds. A spring biased check valve 108 is provided in the outlet passageway 106 to allow the passage of hydraulic control fluid to the control passageway 58 and to the piston and cylinder assembly 50 but preventing reverse flow therethrough.

The control valve 90 is not sensitive to the pressure in the bore 14, but is only responsive to its biasing force, the nitrogen charge 98, and the force of the hydraulic control fluid acting on valve element 96. The control valve 90 is normally closed and thus prevents the hydrostatic head in the control fluid from acting on the piston and cylinder assembly 50 and therefore isolates the assembly 50 from any opening force so that any decrease in the pressure in the bore 14 will not cause the assembly to inadvertently open the valve 10.

It is also to be noted that the control valve 90 may be retrived from the sidepocket 82 by conventional kick-over tools and repaired or replaced. Thus the valve 90 may be replaced with a valve having a different closing force in the event that well conditions change.

Referring now to FIG. 1E, it is to be noted that the fluid control passageway 58 may include one or more coils 110 which may be filled with silicone, if desired, for isolating the control valve 90 from well fluids.

Preferably, the sidepocket 82, as best seen in FIG. 1D, includes a weep hole 110 for releasing any pressure increase in the sidepocket 82 caused by the insertion of the control valve 90 and seals 91 and 93 into the sidepocket 82 which might inadvertently actuate the choke and kill valve 10. Also, in the event that a small leak develops in the seal 93 of the control valve 90, the weep hole prevents a pressure buildup from the annulus which might unintentionally actuate the choke and kill valve 10. However, the weep hole 110 is sufficiently small so as not to interfere with hydraulic control signal flowing from the control valve 90 to the piston and cylinder assembly 50.

Figure 4:
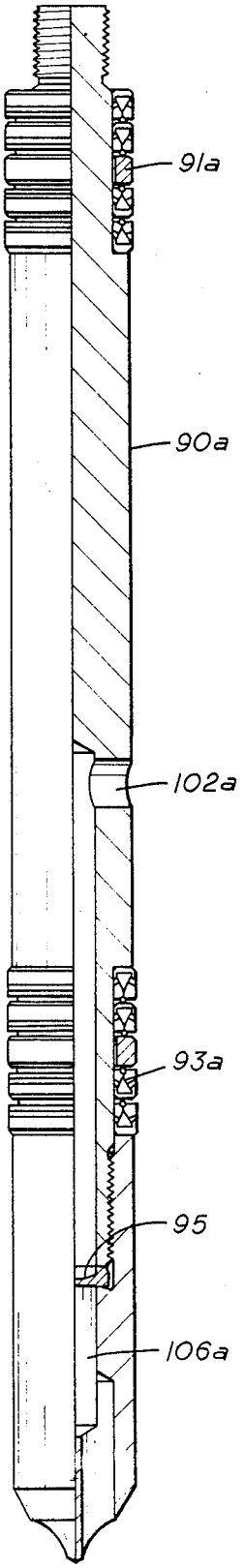
FIG. 4 is an elevational view, partly in cross section, of a rupture disc type flow control means.
Figure 5:
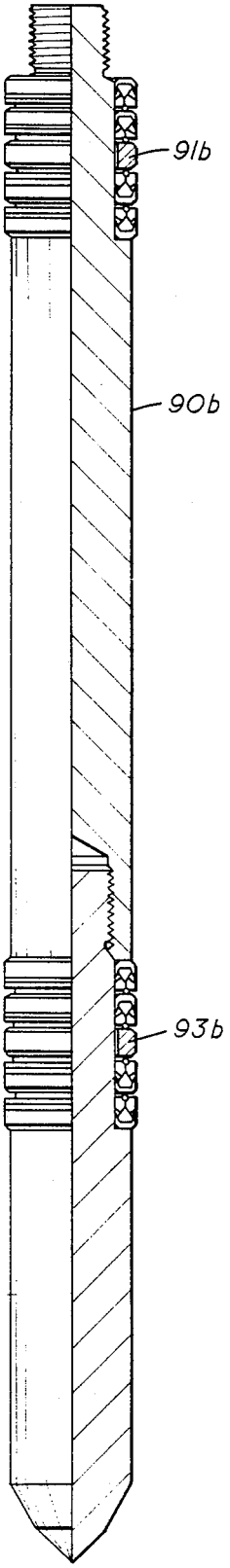
FIG. 5 is an elevational view, partly in cross section, of a blanking control valve for use in locking out the choke and kill valve.

Other and further types of flow control means may be used. Referring to FIG. 4, a flow control valve **90*a* is best seen having an inlet port 102*a* and an outlet port 106*a* and includes a rupture disc 95. The disc 95 may be provided to be actuated at a predetermined force by the hydraulic control fluid for actuating the choke and kill valve 10. Referring now to FIG. 5, a blocking valve 90*b* is shown, which, when inserted in the sidepocket 82, blocks the passage of any hydraulic control fluid by the action of the seals 91*b* and 93*b* which are then positioned across the inlet port 84 of the sidepocket 82. The blocking valve 90*b* is used to prevent actuation of the choke and kill valve 10 and thus can be used when it is desired to lock the choke and kill valve in the open position such as working on the well by inserting other well tools down the well conduit and through the choke and kill valve 10**.

Another problem of the prior art is that the piston and cylinder assembly was subject to contamination from the producing well fluids and such contamination could build up and adversely affect the operation of the assembly.

Referring now to FIG. 1F, the assembly 50 includes at least one non-positive seal means such as a labyrinth seal 55 which may include a plurality of ridges and grooves. A non-positive seal is sufficient for actuating the piston 52 upon the application of a sufficient differential pressure across the piston 52. Therefore, a positive seal is not required. In addition, the non-positive labyrinth seal 55 provides a structure which may be flushed and cleaned periodically for removing contamination buildup.

Figure 3:
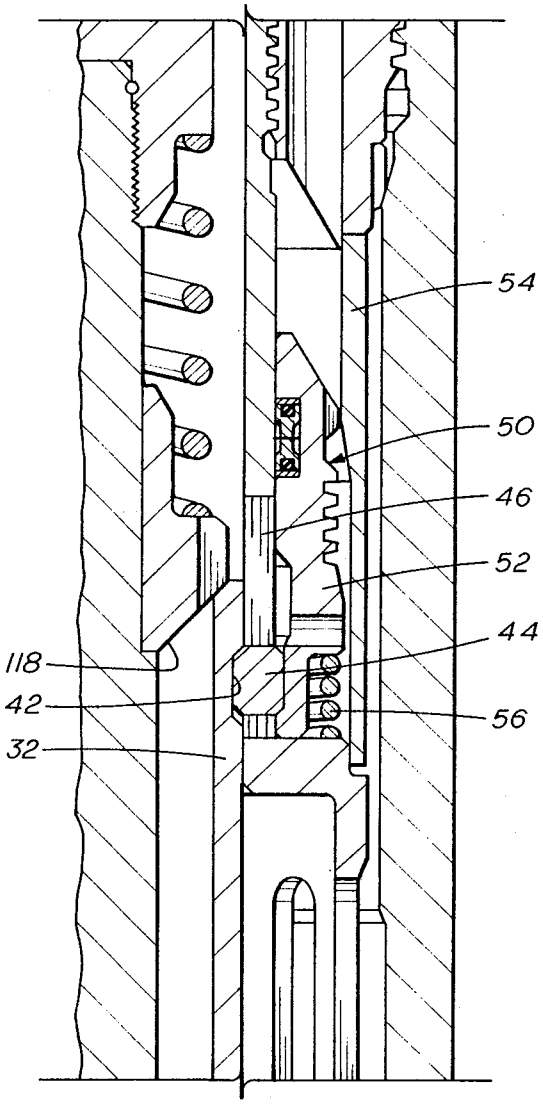
FIG. 3 is an enlarged fragmentary elevational view, in cross section, of the piston and cylinder assembly of FIG. 1F shown in a flushing position.
Figure 7A:
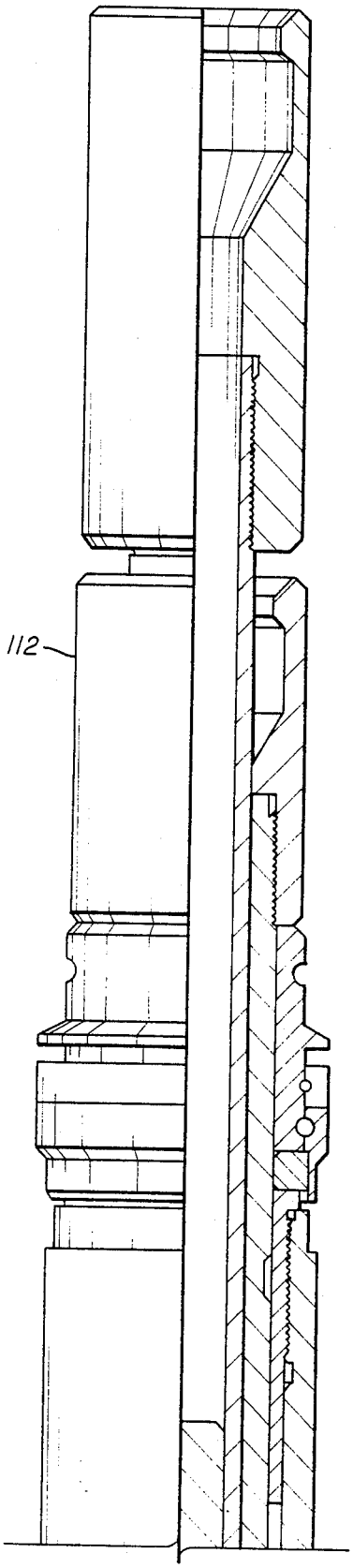
FIGS. 7A, 7B and 7C are continuations of each other and are in elevational view, partly in cross section, illustrating a blanking tool for opening the piston and cylinder assembly for cleaning.
Figure 7B:
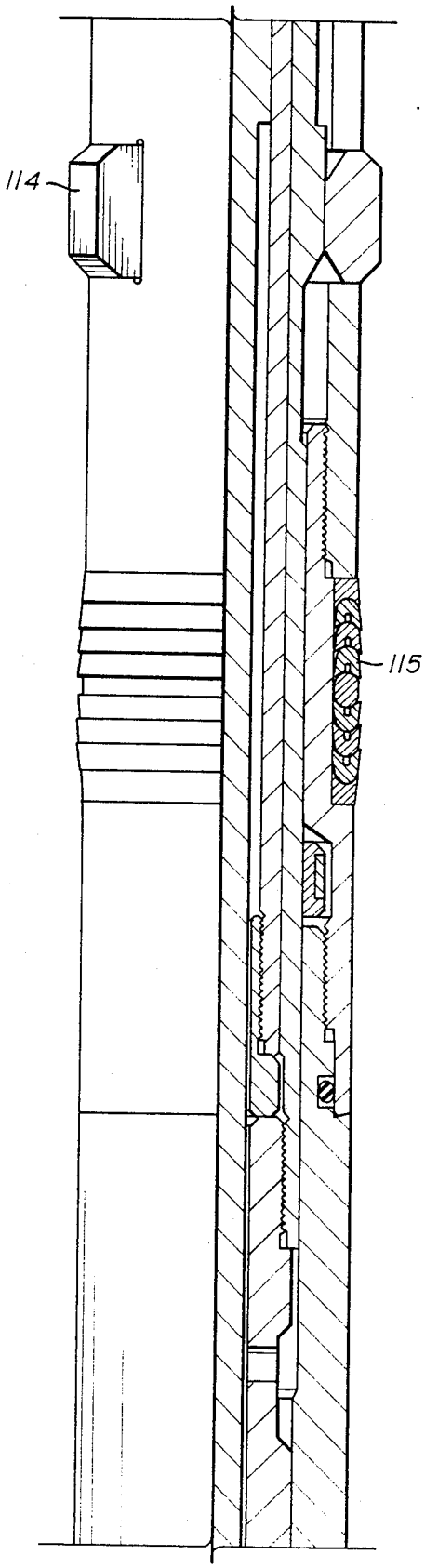
Figure 7C:
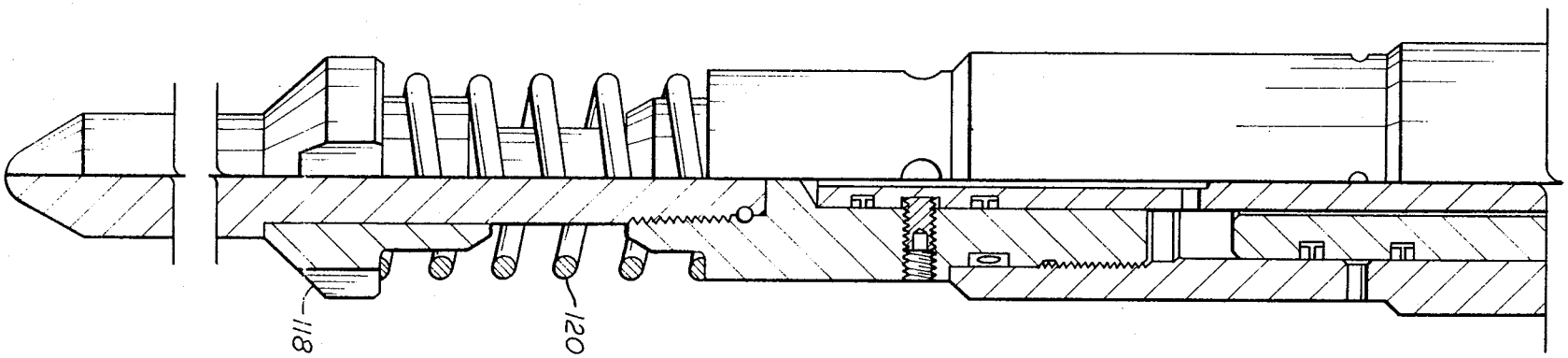

Referring now to FIGS. 7A, 7B and 7C, a blanking plug generally indicated by the reference numeral 112 is shown for insertion into the bore 14 of the choke and kill valve 10 for holding the piston and cylinder assembly in the open position for cleaning. The blanking plug 112 includes a seal 115 and a set of dogs 114 which are adapted to be locked in a recess 116 (FIG. 1E) in the bore 14 and includes a shoulder 118 which is biased downwardly by spring 120. When the tool 112 is positioned in the bore 14, the shoulder 118, as best seen in FIG. 3, acts against the top of the flow tube 32 to move the flow tube 32 downwardly carrying the locking dog 44 and piston 52 downwardly. Since the flapper valve remains in the open position, the well fluid flows behind the flow tube 32 and around the piston 52 and into passageway 58 for cleaning the assembly 50 by well flow. For example, a high pressure gas well, such as 10,000 pounds, will provide a tremendous cleaning force for cleaning the assembly 50.

Figure 6A:
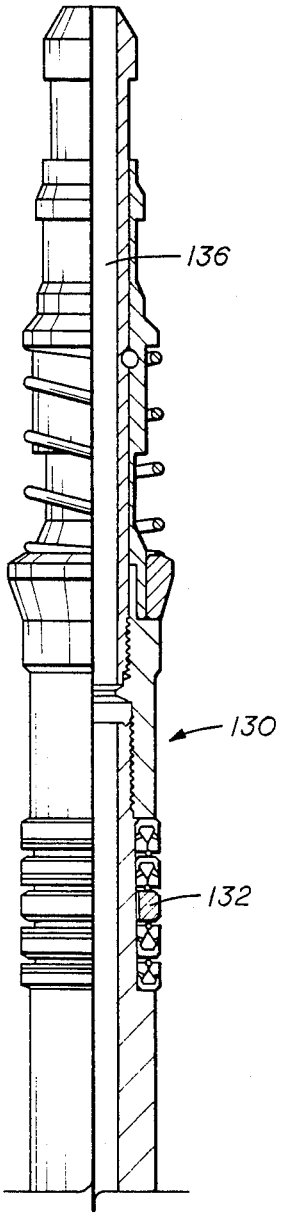
FIGS. 6A and 6B are continuations of each other and form an elevational view, partly in cross section, of a flushing dummy for flushing the piston and cylinder assembly.
Figure 6B:
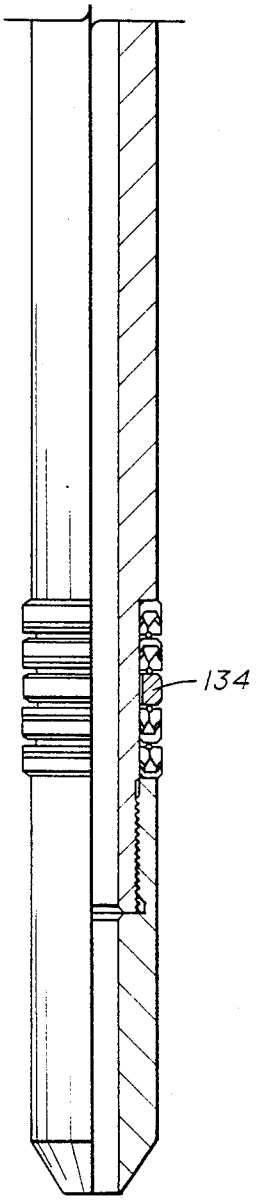

In addition, a flushing dummy, as best seen in FIGS. 6A and 6B, and indicated generally by the reference numeral 130 is inserted in the sidepocket 82 of the sidepocket mandrel 80 in place of the flow valve 90 and is used in conjunction with the blanking plug 112. The flushing dummy 130 includes seal means 132 and 134 for being positioned on opposite sides of the sidepocket mandrel inlet 84 for blocking inlet flow. The flushing dummy 130 includes a flushing passageway 136 therethrough which is in communication at the top with the bore 14 and at the bottom with the flow control pasageway 58. Therefore, well fluids with flow upwardly through passageways 58 and 136 to clean the assembly 50 or, a cleansing fluid, such as diesel oil, may be pumped down through the flushing dummy 130, control passageway 58 and through the piston and cylinder assembly 50 for cleansing.

The present invention, therefore, is well adapted to carry out the objects and attain the ends and advantages mentioned as well as others inherent therein. While a presently preferred embodiment of the invention is given for the purpose of disclosure, numerous changes in the details of cosntruction and arrangement of parts will readily suggest themselves to those skilled in the art and which are encompassed within the spirit of the invention and the scope of the appended claims.

What is claimed is:

1. A control system for a choke and kill safety valve for use in a well conduit, in which the valve includes a housing having a bore therethrough, a sleeve telescopically movable in the housing about the bore, a valve closure member positioned in the housing and connected to the sleeve and movable between open and closed positions in the bore, a flow tube longitudinally movable in the housing for controlling the movement of the valve closure member, means between the sleeve and the flow tube for biasing the flow tube in a direction for causing the valve closure member to move to the closed position, releasable latch means between the sleeve and the flow tube initially holding the flow tube in position holding the valve closure member in the open position, a biased piston and cylinder assembly initially engaging the releasable latch and holding the latch engaged, said assembly being exposed on one side to pressure in the housing, and said housing and said sleeve including openings which when aligned by movement of the sleeve by well pressure allows fluid to be inserted into the bore from the outside of the housing comprising, a sidepocket mandrel having a bore in communication with the bore of the housing, and having a sidepocket, said sidepocket including an inlet port for receiving a control fluid from the well surface, and said sidepocket having an output port in communication with the second side of the piston and cylinder assembly, and flow control means releasably positioned in the sidepocket for the control of fluid between the inlet and the outlet port for controlling the piston and cylinder assembly.

2. The apparatus of claim 1 wherein the flow control means is a control valve having a valve seat and a valve element which is biased to the closed position and the control fluid at the inlet port acts on the control valve in a direction to open the control valve.

3. The apparatus of claim 1 wherein the flow control means includes a rupture disc positioned between the inlet and the outlet port.

4. The apparatus of claim 1 wherein the flow control means includes a blocking valve shutting out flow between the inlet port and the outlet port for holding the choke and kill valve in the open position.

5. The apparatus of claim 1 including a weep port between the sidepocket and the mandrel bore downstream of the flow control means for preventing inadvertent actuation of the choke and kill valve.

6. The apparatus of claim 1 wherein the piston and cylinder assembly includes non-positive seal means and includes a flush opening normally closed by the flow tube but opened by downward movement of the flow tube and exposed to the bore for allowing the assembly to be flushed and cleaned.

7. The apparatus of claim 6 wherein the flow control means includes a flush control means having seal means for sealing on each side of the inlet port and a passageway therethrough for passing flushing fluid from the mandrel bore to the outlet port for cleaning the piston and cylinder assembly.

8. The apparatus of claim 7 including, blanking plug means for insertion into and closing the bore of said housing and for engaging and moving the flow tube and piston downwardly for exposing the flush opening to the bore for flushing the assembly.

9. A choke and kill safety valve system for use in a well conduit comprising, a housing having a bore therethrough, a sleeve telescopically movable in the housing about the bore, a valve closure member positioned in the housing and connected to the sleeve and movable between open and closed positions in the bore, a flow tube longitudinally movable in the housing for controlling the movement of the valve closure member, means between the sleeve and the flow tube for biasing the flow tube in a direction for causing the valve closure member to move to the closed position, releasable latch means between the sleeve and the flow tube initially holding the flow tube in position holding the valve closure member in the open position, a biased piston and cylinder assembly engaging the releasable latch and initially holding the latch engaged, said assembly being exposed on one side to pressure in the housing, said assembly includes non-positive seal means, said housing and said sleeve including openings which when aligned by movement of the sleeve by well pressure allows fluid to be inserted into the bore from the outside of the housing, a sidepocket mandrel having a bore in communication with the bore of the housing, and having a sidepocket, said sidepocket including an inlet port for receiving a control fluid from the well surface, and said sidepocket having an outlet port in communication with the second side of the piston and cylinder assembly, and flow control means releasably positioned in the sidepocket for the control of fluid between the inlet and the outlet port for controlling the piston and cylinder assembly.

* * * * *